United States Patent [19]

St. Pierre

[11] Patent Number: 4,689,964

[45] Date of Patent: Sep. 1, 1987

[54] ZERO GRAVITY (POSITION-INSENSITIVE) LOW-TEMPERATURE MULTI-COMPONENT REFRIGERATOR

[75] Inventor: Michael St. Pierre, Rohnert Park, Calif.

[73] Assignee: Marin-Tek, Inc., San Rafael, Calif.

[21] Appl. No.: 847,232

[22] Filed: Apr. 2, 1986

[51] Int. Cl.[4] ..... F25B 19/00

[52] U.S. Cl. ..... 62/114; 62/502

[58] Field of Search ..... 62/512, 513, 114, 502

[56] References Cited

U.S. PATENT DOCUMENTS 2,041,725 5/1936 Podbielniak ..... 62/114 X 2,990,698 7/1961 Crotser ..... 62/513 X 3,203,194 8/1965 Fuderer ..... 62/114

3,768,273 10/1973 Missimer ..... 62/114 X

*Primary Examiner*—Lloyd L. King

*Attorney, Agent, or Firm*—Jay M. Cantor

[57] ABSTRACT

The disclosure relates to a refrigeration system using a multi-component refrigerant wherein the heat exchanger/phase separator can be positioned in any orientation and does not operate due to gravitational forces. This is accomplished by providing a constriction at the upstream end of the refrigerant path with a capillary tube entry slightly upstream of the constriction, the amount of liquid refrigerant striking the constriction being sufficient to provide an effective liquid seal at the opening to the capillary tube to prevent gaseous refrigerant from entering thereinto.

16 Claims, 2 Drawing Figures

ZERO GRAVITY (POSITION-INSENSITIVE) LOW-TEMPERATURE MULTI-COMPONENT REFRIGERATOR

BACKGROUND OF THE INVENTION

1. Field of the Invention

This invention relates to multi-component self-refrigerating-cascade refrigerators and, more specifically, to such refrigerators capable of operation in any or all orientations of the heat exchanger/phase separator section thereof.

2. Brief Description of the Prior Art

Prior art refrigeration systems have utilized multiple component refrigerants. In such prior art systems, the heavier liquid refrigerant phases were separated from the lighter vapor refrigerant phases by use of gravitational forces. Systems of this type operate properly only under a single orientation of the phase separator. This provides a serious disadvantage for those refrigeration systems wherein the final position of the heat exchanger/phase separator section is not known prior to the time of installation. Also, such prior art systems are incapable of operation in a zero gravity environment and liquid and vapor phase refrigerants can therefore not be properly separated under such conditions to achieve their designed operation goals. Prior art refrigeration systems and procedures also require a significant volume of liquid refrigerant at the entrance to the throttling devices. This is not a serious disadvantage for larger refrigerators, however it is important for miniature models. The extra liquid volume, particularly in the colder portions of the refrigerator, requires additional expansion or storage space to hold the high pressure (low boiling) components of the mixture as a superheated vapor at suitable limited pressures during shutdown.

The prior art systems are generally set forth in the patents of Podbielniak (U.S. Pat. No. 2,041,725), Fuderer (U.S. Pat. No. 3,203,194), and Missimer (U.S. Pat. No. 3,398,202). A typical publication describing the prior art is "One Flow Cascade Cycle", A. P. Kleemenko, 1959, International Institute of Refrigeration, Copenhagen, Denmark. In all instances, a liquid-vapor phase separator which uses gravity for operation is employed. The above are only exemplary of the prior art.

SUMMARY OF THE INVENTION

In accordance with the present invention, gravity is not employed for separation of the liquid and vapor refrigerant phases after the step of partial condensation. The fluid phases are continuously and simply separated by velocity, although not all of the operating principles are fully understood. The invention does not require a liquid-vapor fluid phase separator utilizing gravity and there is no refrigerant vapor expansion tank. The free volume in the hermetically sealed system is sufficient to store the vaporized lower boiling refrigerants when the system is turned off and warmed to non-operating storage or shipping temperatures. This invention provides apparatus which is much simpler than the apparatus or methods required to produce the same low temperatures in the prior art, especially in fractional horsepower sizes.

As stated above, the refrigeration system in accordance with the present invention is designed to be used with a mixture of refrigerants. These refrigerants are separated as vapor and condensates at the trailing end of each heat exchanger through which they pass. These condensates are then throttled and evaporated in the suction return circuit of the following heat exchanger in the system. The throttling devices are capillary tubes which are well suited for the zero gravity and compact size concepts. It is the combination of the evaporating higher boiling refrigerants and high pressure that yields condensates of the lower boiling components of the refrigerant mixture. Each separation point aids in the removal of compressor oil from the colder portion of the heat exchanger circuit, keeping the oil within acceptable levels so as not to freeze and clog the system. The oil which has been removed from the discharge refrigerant stream is returned to the compressor via the capillary tube throttling devices, along with the evaporating condensates, in the return suction line. It can be seen that by carefully picking refrigerants and using multiple heat exchangers, a refrigeration system capable of extremely cold temperatures can be achieved.

While the theory of operation of the system of the present invention cannot presently be accurately described, it is believed that, by placing the capillary tube entrance just ahead of a venturi throat, some sort of standing wave is created, thereby passing mostly or all liquid into the capillary tube entrance while the vapors tend to bypass around the perimeter, thereby achieving the separation necessary for proper system operation to produce cold temperatures at adequate cooling capacities. The system is not limited to two capillary tubes. A three capillary tube system is superior and it is possible that even lower temperatures are attainable with a synthetic lubricating oil in the compressor and/or by using additional heat exchangers followed with their downstream separation points and capillary tubes.

The unique feature of the subject system is that it utilizes only one stage of compression and that the entire heat exchanger package can be of any orientation relative to gravity. It is due to the novel way in which the condensates are separated from the two phase flow that enables this invention to not only function, but also be reliable. Many other designs require the use of hydrocarbons and/or multiple compressors to achieve similar results. The invention as such does not require hydrocarbon refrigerants and works extremely well with safe halocarbon mixtures which have relatively low oil miscibility.

The important feature of the invention is the manner in which the phase separation occurs. Following each heat exchanger is an area wherein the discharge circuit incurs a drastic reduction in volume. At the tail end of this restricted volume (area) point, just prior to the discharge circuit increasing back to its original volume, resides a capillary tube centered in the path of the oncoming two phase refrigerant flow with the pinch-down or reduced cross-section area point just therebehind. When the liquid portion of the two phase mixture contacts this reduced area region, it bounces thereoff in a backward direction for a short distance before travelling on in a forward direction. The churning action developed creates a build-up of liquid at the entrance of the capillary tube, thereby maintaining a fairly constant liquid seal. Although this is only partially separating the condensate from the two phase mixture, it is quite sufficient to effect good oil return and refrigeration efficiency when coupled with one or more successive stages as in Missimer (U.S. Pat. No. 3,398,202). This method of separation lends itself to functioning in any orientation to gravity and most likely in the total absence of gravity (outer space). Since the oil mist and vapor from the compressor is constantly stripped away from the two phase refrigerant flow, first scrubbed by and dissolved into the condensate, then returned along with the condensate to the compressor via the capillary tube, suction line and heat exchanger(s) where the condensate evaporates and the oil (now warmer than its pour point) flows to the compressor, it never has a chance to accumulate and freeze in the system. This has two benefits, one of not plugging vital passageways and also not robbing the compressor of necessary lubricants.

It can be seen that the invention herein offers a refrigerator which is capable of producing low temperatures in the range of −80° C. and lower, operating in any plane or orientation, using only one compressor and non-explosive refrigerants with high reliability.

DESCRIPTION OF THE PREFERRED EMBODIMENT

Figures 1, 2:
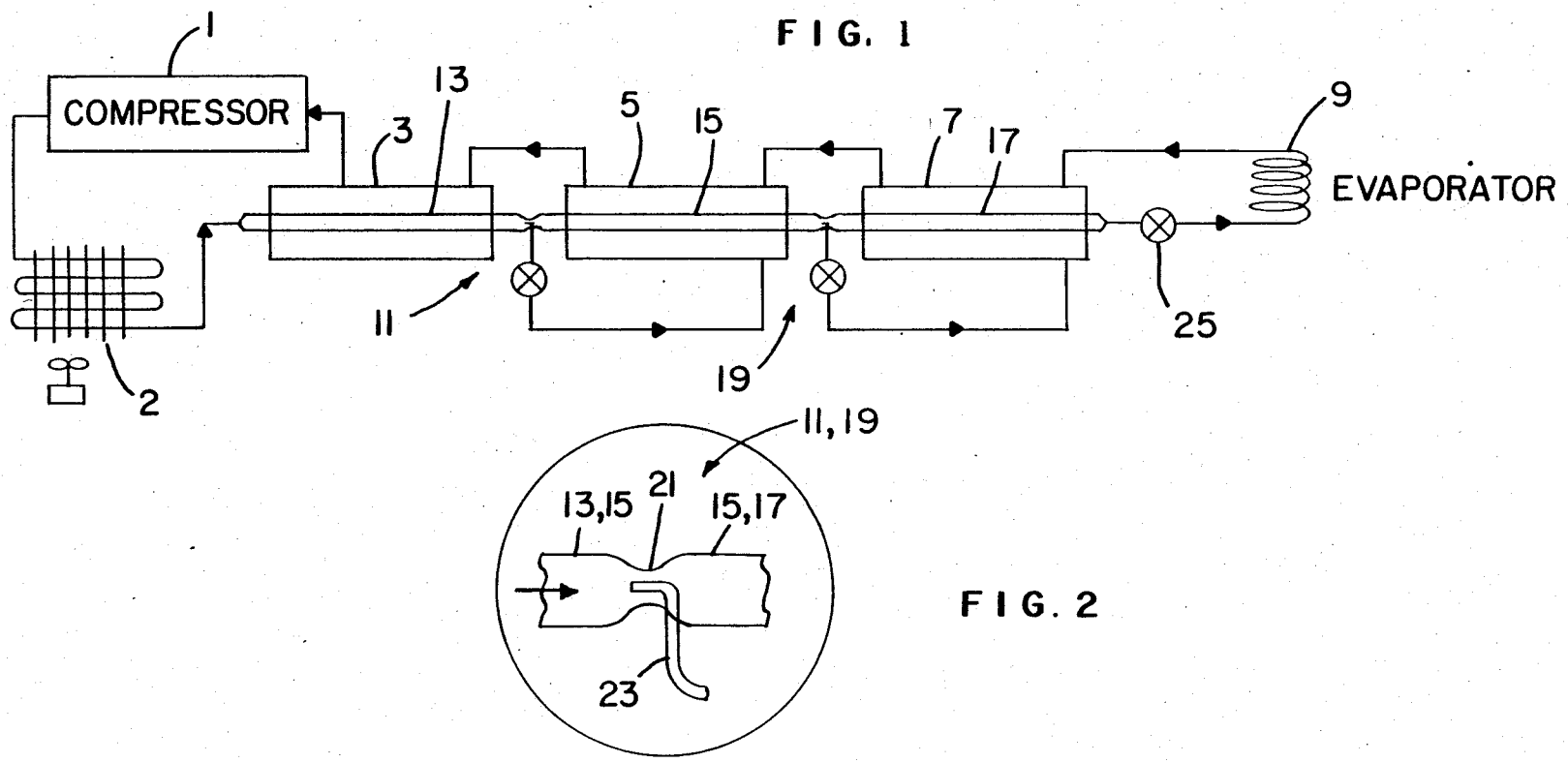
FIG. 1 is a schematic diagram of a refrigeration system in accordance with the present invention.
FIG. 2 is an enlarged view of the Venturi or restricted area and capillary tube therein of FIG. 1.

Referring now to the drawings, there is shown a refrigeration system in accordance with the present invention. The system includes a compressor 1 which drives multi-component, multi-boiling point refrigerent through the central tube of heat exchangers 3, 5 and 7 to an evaporator 9 from when a portion of the total refrigerant enters the suction portion of heat exchanger 7 and travels to heat exchanger 5 and then heat exchanger 3 and back to compressor 1 to complete the cycle. The tube portions 11 and 19 between heat exchanger 3-5 and 5-7 respectively have a restricted portion in the form of a venturi 21 (FIG. 2) with a capillary tube 23 therein. The entrance to the capillary tube 23 is slightly upstream of the most restricted portion of the constriction or Venturi throat 21. Refrigerant entering the capillary tube 23 at portion 11 passes to the suction portion of heat exchanger 5 and refrigerant entering the capillary tube 23 at portion 19 passes to the suction portion of heat exchanger 7.

In operation, multi-component, multi-boiling point refrigerant passes from compressor 1 through air- or water-cooled condenser 2 to heat exchanger 3 herein liquid refrigerant impinges against constriction 21 at tube portion 11. The liquid refrigerant will enter the capillary tube 23 at that point and travel to the suction portion of heat exchanger 5. Gaseous refrigerant will continue along tube 15 wherein some or all of said refrigerant will be cooled and condensed to liquid phase and strike the constriction 21 at tube portion 19. The liquid refrigerant will enter the capillary tube 23 at that point and travel to the suction portion of heat exchanger 7. Gaseous refrigerant will continue along the central tube 17 located within heat exchanger 7 wherein said refrigeratn will be cooled and condensed, enter capillary tube 25 where liquid refrigerant is throttled to suction pressure and pass to the evaporator 9 where it boils to produce useful cooling and from where it will be recirculated to the compressor via the suction portions of heat exchangers 7, 5 and 3.

Since a large enough amount of refrigerant will be used, as stated hereinabove, to essentially seal the capillary tube 23 from the vapor phase refrigerant, it is apparent that the liquid refrigerant will travel along the above noted path, regardless of the orientation of the refrigeration system. In a system having an internal free volume of 2.5 liters, a typical refrigerant mixture would be 0.7 mole fraction R-11 and 0.3 mole fraction R-503 and a total charge of 1.5 gram-moles. This combination produces evaporator temperatures of approximately −80° C. Accordingly, orientation and gravity do not become a factor in the operation of the system.

Though the invention has been described with respect to a specific preferred embodiment thereof, many variations and modifications will immediately become apparent to those skilled in the art. It is therefore the intention that the appended claims be interpreted as broadly as possble in view of the prior art to include all such variations and modifications.

I claim:

1. A refrigeration system which comprises:

(a) a plurality of cascaded heat exchangers, each heat exchanger including a high pressure line and a suction region, said high pressure lines being connected in cascade by a connection region;

(b) a constriction in each said connection region between said heat exchangers; and (c) a capillary tube having an opening disposed at and facing upstream of each said constriction and terminating in a suction region of a said heat exchanger.

2. A refrigeration system as set forth in claim 1 wherein said constriction is in the form of a Venturi.

3. A refrigeration system as set forth in claim 1 wherein said suction regions are connected in cascade.

4. A refrigeration system as set forth in claim 2 wherein said suction regions are connected in cacade.

5. A refrigeration system as set forth in claim 1 wherein said capillary tube terminates in a suction region of a downstream heat exchanger.

6. A refrigeration system as set forth in claim 2 wherein said capillary tube terminates in a suction region of a downstream heat exchanger.

7. A refrigeration system as set forth in claim 3 wherein said capillary tube terminates in a suction region of a downstream heat exchanger.

8. A refrigeration system as set forth in claim 4 wherein said capillary tube terminates in a suction region of a downstream heat exchanger.

9. A refrigeration method which comprises:

(a) providing a plurality of cascaded heat exchangers, each heat exchanger including a high pressure line and a suction region, said high pressure lines being connected in cascade by a connection region, (b) providing a constriction in each said connection region between said heat exchangers;

(c) providing a capillary tube having an opening disposed at and facing upstream of each said constriction and terminating in a suction region of a said heat exchanger; and (d) applying a multi-component refrigerant to said constriction having a liquid phase and a gaseous phase in sufficient volume to substantially seal said gaseous refrigerant from said constriction with said liquid regrigerant.

10. A refrigeration method as set forth in claim 9 wherein said constriction is in the form of a Venturi.

11. A refrigeration method as set forth in claim 9 wherein said suction regions are connected in cascade.

12. A refrigeration method as set forth in claim 10 wherein said suction regions are connected in cascade.

13. A refrigeration method as set forth in claim 9 wherein said capillary tube terminates in a suction region of a downstream heat exchanger.

14. A refrigeration method as set forth in claim 10 wherein said capillary tube terminates in a suction region of a downstream heat exchanger.

15. A refrigeration method as set forth in claim 11 wherein said capillary tube terminates in a suction region of a downstream heat exchanger.

16. A refrigeration method as set forth in claim 12 wherein said capillary tube terminates in a suction region of a downstream heat exchanger.

* * * * *